US005766690A

United States Patent [19]

Derby et al.

[11] Patent Number: 5,766,690

[45] Date of Patent: Jun. 16, 1998

[54] METHOD FOR PRODUCING A SELF LUBRICATING COATING ON A SUBSTRATE

[75] Inventors: James U. Derby, Ashaway; Amitava Datta, East Greenwich, both of R.I.

[73] Assignee: EG&G Sealol, Inc., Cranston, R.I.

[21] Appl. No.: 376,116

[22] Filed: Jan. 20, 1995

Related U.S. Application Data

[63] Continuation of Ser. No. 54,261, Apr. 30, 1993, abandoned.

[51] Int. Cl.[6] ..... C23C 4/10

[52] U.S. Cl. ..... 427/450; 427/451; 427/455

[58] Field of Search ..... 427/450, 451, 427/455

[56] References Cited

U.S. PATENT DOCUMENTS

| | | | |
|---|---|---|---|
| 3,419,363 | 12/1968 | Sliney | 29/182.1 |
| 3,508,955 | 4/1970 | Sliney | 117/119 |
| 3,711,171 | 1/1973 | Orkin et al. | 308/241 |
| 3,953,343 | 4/1976 | Sliney | 252/12 |
| 4,728,448 | 3/1988 | Sliney | 252/12.2 |
| 5,034,184 | 7/1991 | Sliney et al. | 419/14 |

FOREIGN PATENT DOCUMENTS

| | | |
|---|---|---|
| 0375931 | 7/1990 | European Pat. Off. . |
| 0415851 | 3/1991 | European Pat. Off. . |
| 0375931 A3 | 10/1991 | European Pat. Off. . |
| 0482831 | 4/1992 | European Pat. Off. . |
| 0487273 | 5/1992 | European Pat. Off. . |
| 2-159359 | 6/1990 | Japan . |

OTHER PUBLICATIONS

R.W. Smith et al., "High Velocity Oxy-Fuel Spray Wear Resistant Coatings of TiC Composite Powders," Thermal Spray Research and Applications, Proceedings of the Third National Thermal Spray Conference, pp. 617–623, May 20–25, 1990.

E. Cove et al., "Hypervelocity Application of Tribological Coatings," pp. 123–130. (No Date).

K.A. Kowalsky et al., "HVOF: Particle, Flame Diagnostics and Coating Characteristics," Thermal Spray Research and Applications, Proceedings of the Third Annual Thermal Spray Conference, pp. 587–592, May 20–25, 1990.

*Primary Examiner*—Katherine Bareford

*Attorney, Agent, or Firm*—Finnegan, Henderson, Farabow, Garrett & Dunner, L.L.P.

[57] ABSTRACT

A composite material comprising a matrix including chromium carbide particles, and a solid lubricant mixed with the matrix and including barium fluoride and calcium fluoride. The composite material is spray deposited onto a substrate using a high velocity oxy-fuel (HVOF) spray technique to provide an HVOF spray coating.

10 Claims, 4 Drawing Sheets and has a particle sizing controlled to about −170 to +400 mesh. Again, it is contemplated that the weight percentages and particle sizings of the solid lubricant including the calcium flouride and barium flouride can be modified to suit a particular application.

According to the present invention, the composite material is spray deposited onto a substrate using a high velocity oxy-fuel (HVOF) spray technique to provide an HVOF spray coating. Reference to an HVOF spray technique for the present invention includes any thermal spray technique utilizing a fuel and oxygen combustion process to impart a high velocity, e.g., 1500 ft/sec or greater, to particles in a thermal spray stream. Examples of such HVOF spray techniques are described, for instance, in R. W. Smith, et al., *High Velocity Oxy-Fuel Spray Wear Resistant Coatings Of TiC Composite Powders*, Thermal Spray Research and Applications, Proceedings of the Third National Thermal Spray Conference, Long Beach, Calif., USA/20–25 May 1990; K. A. Kowalsky, et al., *HVOF: Particle, Flame Diagnostics and Coating Characteristics*, Thermal Spray Research and Applications, Proceedings of the Third National Thermal Spray Conference, Long Beach, Calif., USA/20–25 May 1990; and E. Cove and R. Cole, *Hypervelocity Application Of Tribological Coatings*. The substrate can comprise virtually any type of material including, but not limited to, metallic, polymer or ceramic materials. Commercial HVOF systems presently available include, for example, Jet Kote™, Diamond Jet™, CDS™, Top Gun™, JP 5000™ and D Gun™.

In the present invention, oxygen and fuel gas are mixed and ignited to produce a carrier gas. The composite material is introduced into the center of the gas stream, thereby heating the particles to temperatures near their melting point, and providing them with a high kinetic energy, e.g., velocities up to 4,500 ft./sec, before impacting onto the substrate. The extremely high kinetic energy creates an HVOF spray coating with exceptionally high bond strength.

Preferably, hydrogen is used as the fuel gas with a flow about twice that of the oxygen. Further, argon is preferably employed as a carrier gas for the composite material powder. With this arrangement, about 0.010 inch of coating can be spray deposited on a part using roughly six vertical passes of the HVOF stream, although typical coating thickness can be in the range of about 0.006–0.010 inches depending on the spray parameters and substrate material.

It is noted that, in the present invention, HVOF spraying utilizes much lower temperatures than plasma spraying, but extremely high particle velocities to achieve bonding of the composite material to the substrate, thereby allowing the chrome carbide and solid lubricant to be co-deposited efficiently for cost effective usage during production. Also, fine particles of solid lubricant are employed into the coating without volatile loss, thereby enhancing the friction and wear properties of the HVOF spray coating. Further, because HVOF techniques use relatively low temperatures, in the present invention, little or no volatilization of the solid lubricant occurs making deposition of the composite material very efficient. The process also allows the composite material to be deposited with reproducible characteristics.

Finally, unlike conventional coatings such as that disclosed in U.S. Pat. No. 4,728,448, composite material according to the present invention contains no silver. This lack of silver makes the present invention an ideal low friction candidate for aerospace high temperature applications including slow speed static sealing devices for ducting system components, and high speed applications including gas path seals such as brush seals.

Applicants conducted friction tests on conventional chromium carbide coatings which contain various amounts of silver (12% and 8%), and the HVOF spray coating according to the present invention to evaluate their break away forces. The tests were conducted at temperatures of about 1200° F. and pressures of about 400 psi. Up to 3,000 sliding cycles where tested, wherein each cycle consisted of a slow rotation in one direction, coming to a stop, followed by a slow rotation in the reverse direction. Break away forces were measured at the end of a five minute hold time in between sliding cycles.

As a result of these tests, the static friction traces of FIGS. 1(A) and 1(B) and FIG. 2 were obtained. As shown in FIGS. 1(A) and 1(B), the conventional coatings produced relatively high break away forces and high coefficients of static friction. Further, after the accumulation of hundreds of sliding cycles, higher static friction coefficients were measured and large percentages of silver were observed at the sliding interface. As shown in FIG. 2, however, the HVOF spray coating according to the present invention exhibited essentially no increased break away forces, and lower sliding friction even after the accumulation of 3,000 sliding cycles.

Friction and wear tests were also conducted on various tribological pairs including the HVOF spray coating of the present invention to identify those pairs which are suitable for use in high speed sliding applications. The HVOF spray coating was applied to a substrate comprising Inconel 718®, and the tests were conducted at temperatures of about 1200° F. and at speeds of about 520 ft/sec. Table I summarizes the results of these tests giving the dynamic coefficient of friction Pf for various ones of the tribological pairs tested.

TABLE I

| μf | TRIBOLOGICAL PAIR |
|---|---|
| .25 | Haynes 214 ® vs. invention |
| .30 | Haynes 230 ® vs. invention |
| .35 | Inconel 956 MA ® vs. invention |
| .40 | Inconel 718 ® vs. invention |
| .40 | Haynes 25 ® vs. invention |

It is preferable that a tribological pair exhibits low friction in order to minimize frictional heating during high speed sliding, thereby ensuring that components will not yield due to excessive temperatures. It is also preferable that performance of a tribological pair be uniform over a wide range of speeds. Most tribological pairs, however, show trends of increasing friction at elevated temperatures and sliding speeds. Further, many tribological pairs exhibit cracking and spalling of the coating and of oxide surface layers on the metallic alloy, and excessive metallic transfer also occurs onto the coating which causes increased friction due to galling. For example, the wear surfaces of a conventional chromium carbide coating and Haynes 25®, a commonly used tribological pair, are shown in FIGS. 3(A) and 3(B), respectively. As shown in these scanning electron microscope photographs, there is a presence of microcracking on the chromium carbide coating and spalling of surface oxides on the Haynes 25®.

As shown in Table I, the HVOF spray coating according to the present invention, however, exhibits low friction when sliding against many different materials at high speed. As further shown in Table I, the lowest friction is observed when sliding against Haynes 214®. The low friction behavior is due to the existence of a crack resistant microstructure, the formation of lubricating layers of barium fluoride and

METHOD FOR PRODUCING A SELF LUBRICATING COATING ON A SUBSTRATE

This application is a continuation of application Ser. No. 08/054,261 filed Apr. 30, 1993, now abandoned.

BACKGROUND OF THE INVENTION

1. Field of the Invention

The present invention relates to composite materials and, more particularly, to a composite material of chromium carbide and a solid lubricant especially, but not exclusively, suited for use as a high velocity oxy-fuel spray coating.

2. Description of the Related Art

U.S. Pat. No. 4,728,448 issued to Sliney discloses a self-lubricating composite material comprising chromium carbide and solid lubricant particles, wherein the composite material is applied to metallic substrates using an air plasma spray technique.

Air plasma spraying involves the use of a plasma forming gas as both a heat source and propelling agent. A high voltage arc excites the plasma gas by ionization. The coating powder is injected (typically from an external powder port) into the hot plasma stream, which melts the powder and deposits it at relatively low velocities, e.g., 300–500 ft/sec, onto a substrate. Typical parameters for this process involve the use of argon as the primary gas and hydrogen as the secondary gas, with typical flows of 40 and 25 scfm, respectively. A typical arc current is 450 to 475 amps.

The air plasma spray produces extremely high temperatures which partially melt the particles to bond them to the substrate. The high temperatures have the negative effect of volatilizing the solid lubricant compositions. Accordingly, when high temperature parameters are used, the chrome carbide is deposited with good efficiency, but little or no solid lubricant is retained in the coating. When the heat parameters are reduced to retain the solid lubricants, the deposition efficiency of the chrome carbide is so low that it is not economically feasible to apply it.

In an attempt to improve the deposition rate of the coating and retention of the solid lubricant, coarse particle sizes can be selected for the solid lubricants so that some percentage of solid lubricant can be retained. However, the coarseness of the particles is detrimental to the friction and wear performance of the coating.

SUMMARY OF THE INVENTION

Features and advantages of the invention will be set forth in part in the description which follows, and in part will be apparent from the description, or may be learned by practice of the invention. The objects and other advantages of the invention may be realized and attained by the combinations particularly pointed out in the written description, claims and appended drawings.

To achieve these and other advantages, and in accordance with the purposes of the invention as embodied and broadly described herein, a composite material for use as a high velocity oxy-fuel spray coating is provided. The composite material comprises a matrix including chromium carbide particles, and a solid lubricant mixed with the matrix and including barium fluoride and calcium fluoride.

In another aspect of the invention, a method of producing a coating on a substrate is provided. The method comprises the steps of providing a matrix including chromium carbide particles, mixing with the matrix a solid lubricant including barium fluoride and calcium fluoride to form a composite material, and using a high velocity oxy-fuel technique to spray deposit the composite material onto the substrate.

In yet another aspect of the invention, a tribological material combination is provided. The combination comprises a substrate, and a composite material including a matrix having chromium carbide particles, and a solid lubricant mixed with the matrix and having barium fluoride and calcium fluoride. The composite material is spray deposited on the substrate to form a high velocity oxy-fuel spray coating, and the combination further comprises a metallic material in frictional engagement with the high velocity oxy-fuel spray coating.

It is to be understood that both the foregoing general description and the following detailed description are exemplary and explanatory and are intended to provide further explanation of the invention as claimed.

BRIEF DESCRIPTION OF THE DRAWINGS

The accompanying drawings which are included to provide a further understanding of the invention and are incorporated in and constitute a part of the specification, illustrate a preferred embodiment of the invention and, together with the description, serve to explain the principles of the invention.

In the drawings.

DESCRIPTION OF THE PREFERRED EMBODIMENTS

Reference will now be made in detail to the present preferred embodiment of the invention.

As embodied herein, a composite material comprises a matrix including chromium carbide particles, and a solid lubricant mixed with the matrix and including barium fluoride and calcium fluoride. It should be appreciated that the component materials for both the matrix and solid lubricant are commercially available in powder form.

Preferably, the matrix further includes a metallic binder such as nickel aluminum or nickel chromium, wherein the metallic binder has a weight of about 20% of a total weight of the matrix. Further, the matrix preferably has a weight of about 85–96% of a total weight of the composite material, and has a particle sizing controlled to about −325 mesh. It is contemplated that the weight percentages and particle sizings of the metallic binder and the matrix can be modified to suit a particular application.

Figure 1A:
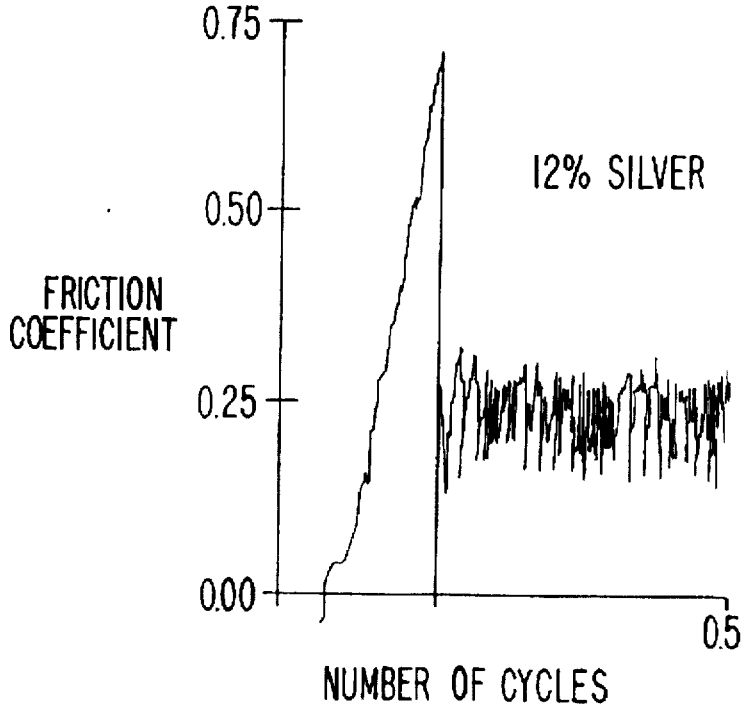
FIG. 1(A) PRIOR ART
FIGS. 1(A) and 1(B) are static friction traces of conventional chromium carbide coatings containing various amounts of silver applied to a substrate using an air plasma spray technique.
Figure 1B:
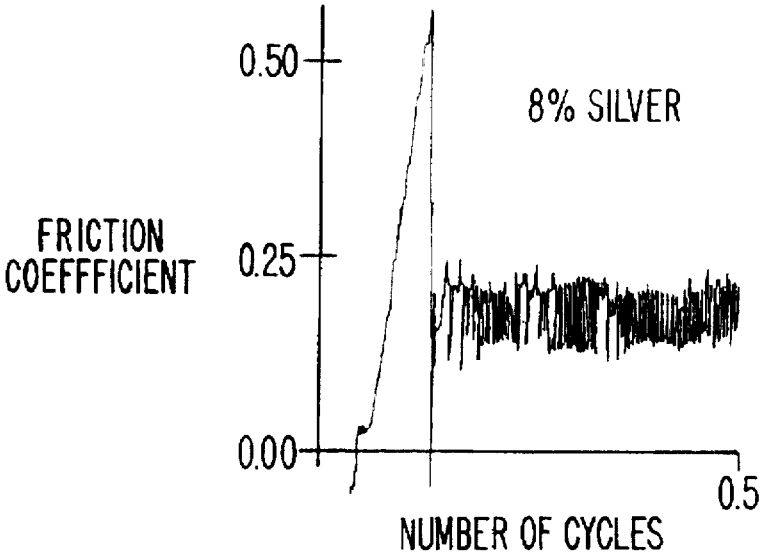
FIG. 1(B) PRIOR ART
Figure 2:
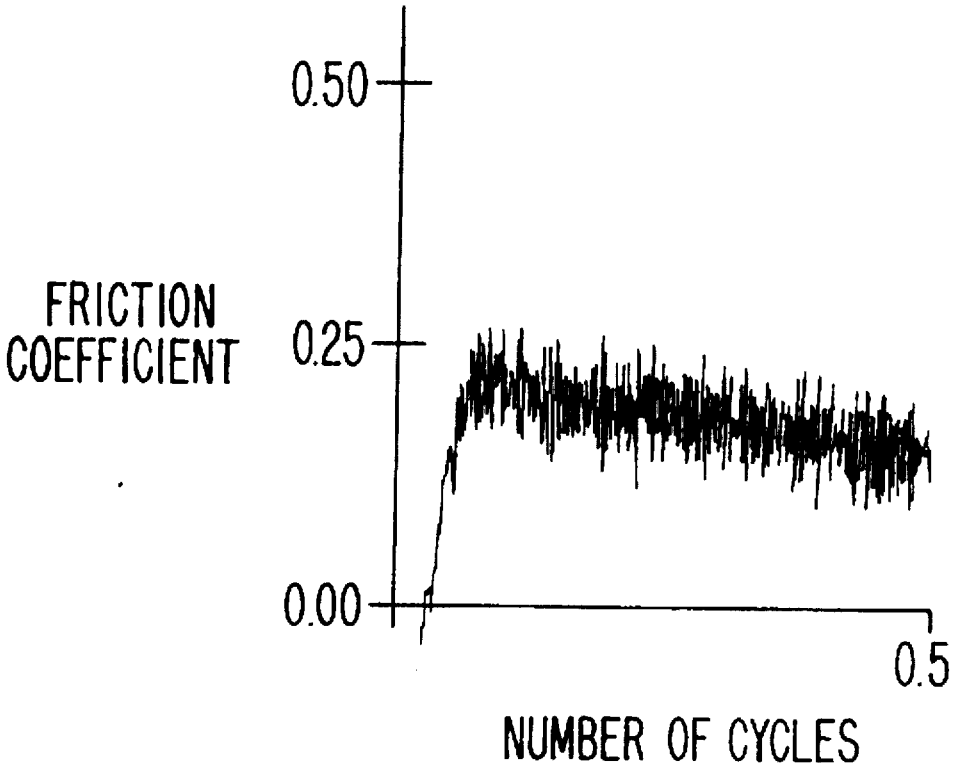
FIG. 2 is a static friction trace of a high velocity oxy-fuel spray coating in accordance with the present invention.
Figure 3A:
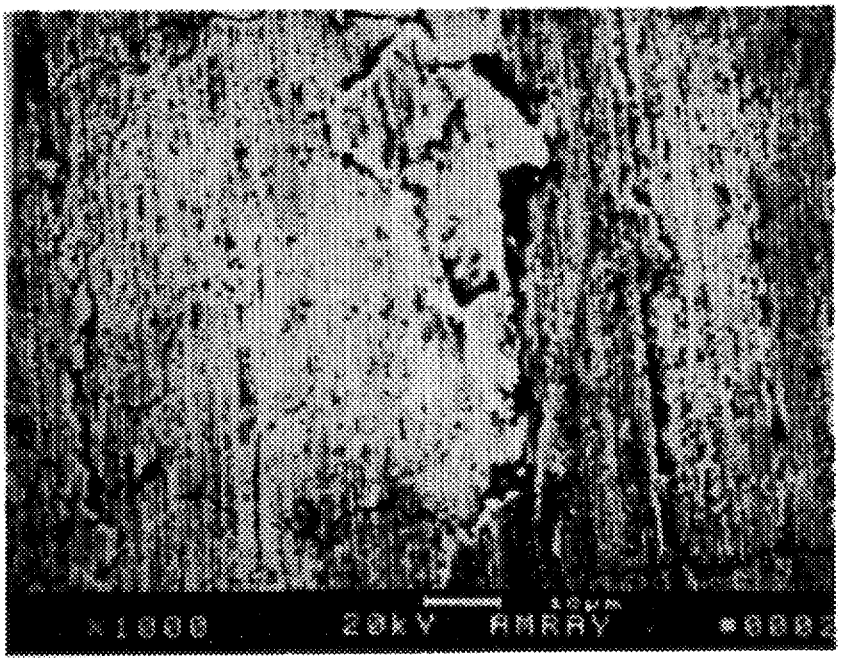
FIG. 3(A) PRIOR ART
FIGS. 3(A) and 3(B) are scanning electron microscope photographs of a wear track of a conventional chromium carbide coating and Haynes 25® tribological pair.
Figure 3B:
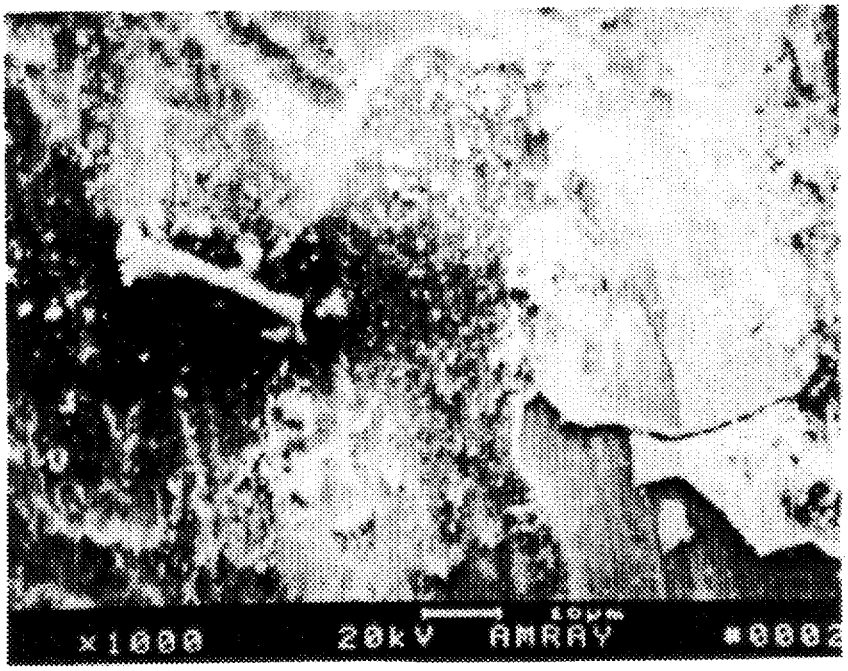
FIG. 3(B) PRIOR ART
Figure 4A:
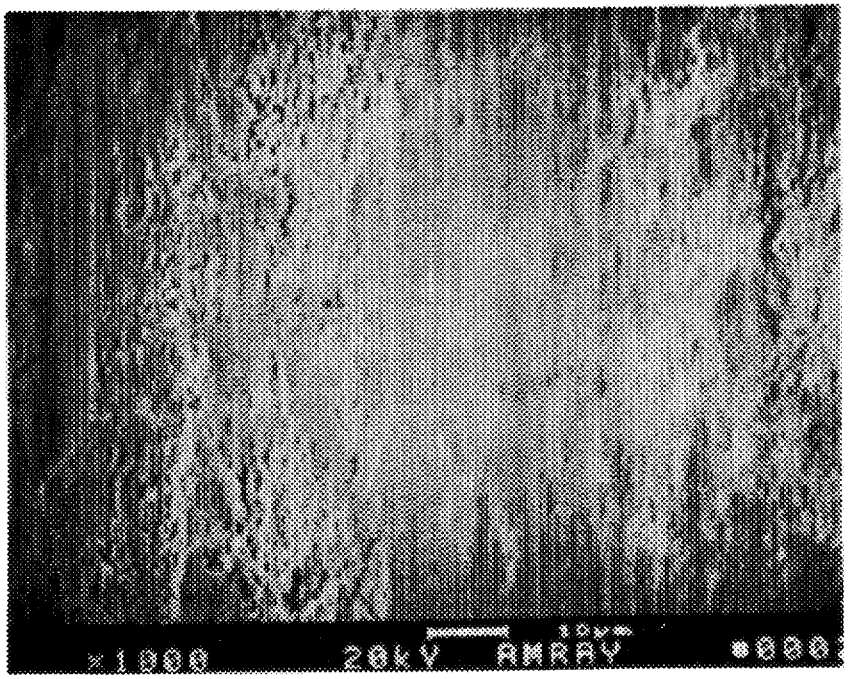
FIGS. 4(A) and 4(B) are scanning electron microscope photographs of a similar wear track of a high velocity oxy-fuel spray coating in accordance with the present invention and Haynes 214® tribological pair.
Figure 4B:
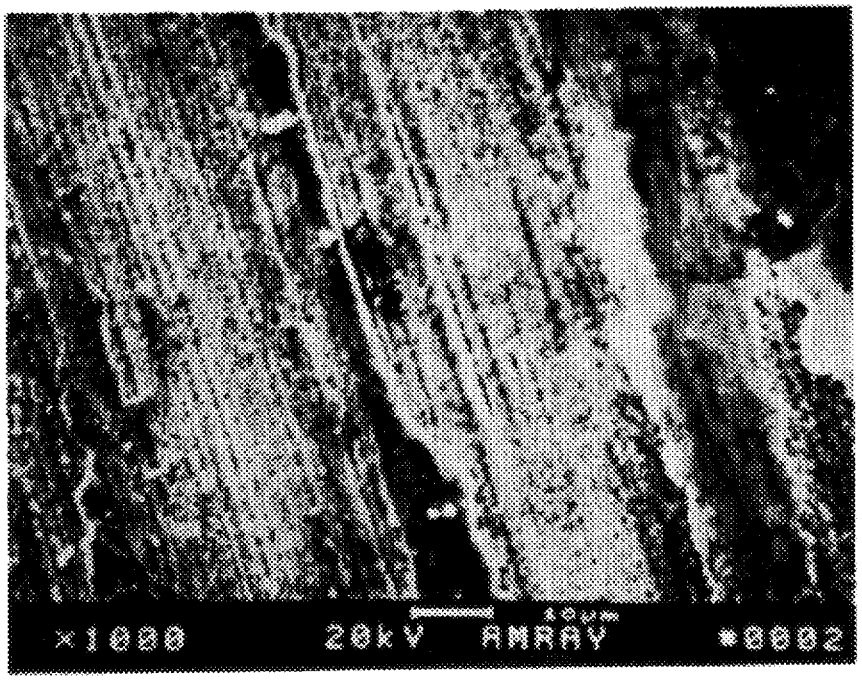

Preferably, the solid lubricant is a eutectic composition, wherein a weight of the calcium fluoride is about 68% of a total weight of the solid lubricant and a weight of the barium fluoride is about 32% of the total weight of the solid lubricant. Further, the solid lubricant preferably has a weight of about 4–15% of a total weight of the composite material, calcium fluoride which deters metallic transfer at the coating interface, and the presence of a tenacious oxide layer on the Haynes 214® surface. Scanning electron microscope photographs of the coating and Haynes 214® wear surfaces are shown in FIGS. 4(A) and 4(B), respectively. It should be evident from FIGS. 4(A) and 4(B) that the HVOF spray coating of the present invention has improved friction and wear characteristics than the conventional chromium carbide coating.

While the present invention has been described with reference to a preferred embodiment thereof, additional advantages and modifications of the present invention will readily occur to those skilled in the art. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A method of producing a coating on a substrate, the method comprising the steps of:

providing a matrix of particles including chromium carbide, the particles having a particle size of about −325 mesh;

mixing with the matrix a solid lubricant including barium fluoride and calcium fluoride particles to form a composite material;

providing a high velocity oxy-fuel gas stream; and introducing the composite material into the gas stream to spray deposit the composite material onto the substrate.

2. The method of claim 1, wherein the matrix further includes a metallic binder.

3. The method of claim 2, wherein the metallic binder has a weight of about 20% of a total weight of the matrix.

4. The method of claim 1, wherein the matrix has a weight of about 85–96% of a total weight of the composite material.

5. The method of claim 1, wherein the solid lubricant is a eutectic composition.

6. The method of claim 1, wherein a weight of the calcium fluoride is about 68% of a total weight of the solid lubricant and a weight of the barium fluoride is about 32% of the total weight of the solid lubricant.

7. The method of claim 1, wherein the solid lubricant particles have a particle size of about −170 to +400 mesh.

8. The method of claim 1, wherein the solid lubricant has a weight of about 4–15% of a total weight of the composite material.

9. The method of claim 1, wherein the composite material is spray deposited onto the substrate to produce the coating with a thickness of about 0.006–0.010 inches.

10. The method of claim 1, wherein the substrate is any one of a metallic, polymer, and ceramic substrate.

* * * * *